US005884813A

United States Patent [19]

Bordonaro et al.

[11] Patent Number: 5,884,813

[45] Date of Patent: Mar. 23, 1999

[54] METHOD AND APPARATUS FOR DISPENSING PLAIN WATER FROM A POSTMIX CARBONATED BEVERAGE DISPENSER

[75] Inventors: Robert J. Bordonaro, Torrington; David C. Stewart, Harwinton, both of Conn.

[73] Assignee: IMI Wilshire Inc., Anoka, Minn.

[21] Appl. No.: 794,946

[22] Filed: Feb. 4, 1997

[51] Int. Cl.[6] ..... B67D 5/56

[52] U.S. Cl. ..... 222/129.1; 222/1; 222/146.6; 137/884

[58] Field of Search ..... 222/1, 129.1, 146.6; 137/884

[56] References Cited

U.S. PATENT DOCUMENTS 4,485,940 12/1984 Brown ..... 222/129.1
4,592,490 6/1986 McMichael ..... 222/129.1
5,368,198 11/1994 Goulet ..... 222/129.1
5,392,960 2/1995 Kendt ..... 222/129.1
5,433,348 7/1995 Deering et al. ..... 222/129.1
5,499,744 3/1996 Hawkins ..... 222/129.1
5,685,458 11/1997 Durham et al. ..... 222/129.1
5,715,700 2/1998 Credle, Jr. ..... 222/129.1

*Primary Examiner*—J. Casimer Jacyna
*Attorney, Agent, or Firm*—Sten Erik Hakanson

[57] ABSTRACT

A carbonated beverage dispenser is provided with a station for dispensing chilled still water. The dispenser includes an adapter block which is easily installed in place of a standard dispensing valve, blocks the soda delivery tube and accepts chilled water from a syrup delivery tube for dispensing through a standard spigot.

4 Claims, 3 Drawing Sheets

METHOD AND APPARATUS FOR DISPENSING PLAIN WATER FROM A POSTMIX CARBONATED BEVERAGE DISPENSER

BACKGROUND OF THE INVENTION

This invention relates to a postmix carbonated beverage dispenser and in particular to a method and apparatus for dispensing plain water from such dispensers.

Beverage dispensers are commercially available from a number of sources. One beverage dispenser is described in U.S. Pat. No. 5,392,960 to Kendt, et al. which is incorporated herein by reference.

Carbonated beverages are sold in restaurants, snack shops, amusement parks, fast food outlets, and other establishments throughout the world. Many of these beverages are mixed and dispensed in postmix beverage dispensers. Generally, a postmix beverage dispenser is provided with a plurality of flavoring syrups and carbonated water which are chilled, mixed and dispensed into a cup or glass. Postmix beverage dispensers generally comprise at least one soda tube carrying carbonated water (sometimes referred to as soda) to a soda manifold which supplies a number of additional soda tubes leading to dispensing valves. A plurality of syrup tubes carry flavoring syrup from sources of syrup through tubes into dispensing valves. The syrup and soda tubes are normally chilled and portions of the tubes are embedded in a body of insulation to maintain the low temperature of the soda and syrup after it has been chilled. The downstream ends of the soda and syrup tubes are usually restrained in a mounting plate which positions the tubes appropriately and provides a convenient place to mount the beverage dispensing valves. Each beverage dispensing valve engages an adjacent pair of tubes, one carrying soda and one carrying flavoring syrup. Generally, the inlets to the dispensing valves are standardized on one of a small number of configurations. The spacing between the soda and the syrup tube is precisely set. The diameter and configuration of the fitting at the end of the syrup and soda tubes are also closely specified. Fittings generally have O-rings upon them providing leakproof engagement with recesses in the beverage dispensing valve. The spacing between adjacent pairs of tubes is also specified so that a beverage dispenser may carry the maximum number of standard size dispensing valves in a given area.

Beverage dispensers and beverage dispensing valves are commercially available from a variety of sources. The beverage dispensing valve of one manufacturer can normally be applied to the beverage dispenser of a different manufacturer following the same standard. The beverage dispensing valve of a first manufacturer can be removed from the beverage dispenser and the beverage dispensing valve of a second manufacturer put in its place with no modification to the beverage dispenser. The syrup and soda tube placement and fitting requirements of both valves are identical.

This industry wide arrangement has proven convenient in many respects. A restaurant operator can install a beverage dispenser and put dispensing valves as desired on the dispenser to provide various flavors of beverages such as cola, orange, lemon-lime, and the like. Should the restaurant operator decide to change the mix of flavors, he need only connect a different syrup reservoir to a given syrup tube and change the label or the beverage dispensing valve on the other end of that syrup tube. The beverage dispenser need not be altered. This is important because the beverage dispensers are complex devices which cannot be conveniently altered in the field.

Beverage dispensers usually include a chiller. The chiller can take the form of an ice bank mechanical refrigeration unit in which soda and syrup tubes are maintained in a bath of cold water chilled by tubes forming part of a refrigeration unit. An "ice bank" normally forms around the tubes in the bath. Alternatively, the chiller can be an aluminum cold plate in which syrup and soda tubes are embedded and to which a body of ice is applied. In either case, the syrup and soda tubes exiting the chiller are maintained in a body of insulation which is usually foamed in place insulation. The ends of the soda and syrup tubes which will engage beverage dispensing valves are maintained in place by a mounting plate. Once such a structure is manufactured, it is virtually impossible to modify the syrup and soda tubes without seriously degrading the insulated nature of the beverage dispenser itself. These units provide flexibility in the provisioning of carbonated beverages. However, providing plain water through a such a beverage dispenser is difficult. One must either put a plain water dispensing station in the beverage dispenser when manufactured or forego plain water dispensing. If one puts a plain water dispensing station in the beverage dispenser, one foregoes one of the available carbonated beverage dispensing stations. This is not an option desired by most restaurant operators as a permanent solution.

This dilemma and other problems are overcome by the present invention wherein a postmix beverage dispenser is adapted to provide either a carbonated beverage or plain water as selected by the restaurant operator through any of the stations or positions in the beverage dispenser.

SUMMARY OF THE INVENTION

In accordance with the present invention there is provided a beverage dispenser having a chiller for syrup and soda, a plurality of syrup and soda tubes leading to paired syrup and soda tube ends at a mounting plate for mounting dispensing valves and a plain water dispensing adapter having a plain water spigot, a blind hole sealing the soda tube end and a syrup hole receiving water from a syrup tube and providing the water to the spigot.

Further in accordance with the invention, the plain water adapter has mounting holes and syrup and soda tube ends receiving sockets having dimensions identical to those of a standard carbonated beverage dispensing valve.

Still further in accordance with the invention, the plain water dispensing adapter block is fabricated from a dimensionally stable plastic.

Still further in accordance with the invention, the tube end receiving sockets on the plain water adapter block are self-sealing with respect to the tube end fitting whereby no special steps are required to provide plain water dispensing.

Still further in accordance with the invention, a method of providing plain water dispensing in a carbonated beverage dispenser comprises the steps of providing an adapter block having syrup and water receiving sockets identical to those of a standard beverage dispensing valve and a water spigot communication with the syrup receiving socket, applying the adapter block to a beverage dispenser, and connecting the other end of the selected syrup tube to a source of plain water.

It is the primary object of the present invention to allow the dispensing of plain water from a carbonated dispensing valve station in a beverage dispenser.

It is another object of the present invention to provide flexibility in beverage dispensing to restaurant operators.

It is still another object of the present invention to provide a plain water dispensing station in a carbonated beverage dispenser which does not require a dedicated plain water station in the manufacturing of the beverage dispenser.

It is yet another object of the present invention to provide a method of dispensing plain water from a carbonated beverage dispenser which does not require separate sealing steps when applying a plain water spigot to a conventional carbonated beverage dispensing station.

These and other objects of the invention will become apparent from the following description of a preferred embodiment thereof taken together with the accompanying drawings.

BRIEF DESCRIPTION OF THE DRAWINGS

The invention may take physical form in certain parts and arrangements of parts, a preferred embodiment of which is described in detail below and illustrated in the accompanying drawings forming a part hereof wherein.

DETAILED DESCRIPTION OF THE PREFERRED EMBODIMENT

Figure 1:
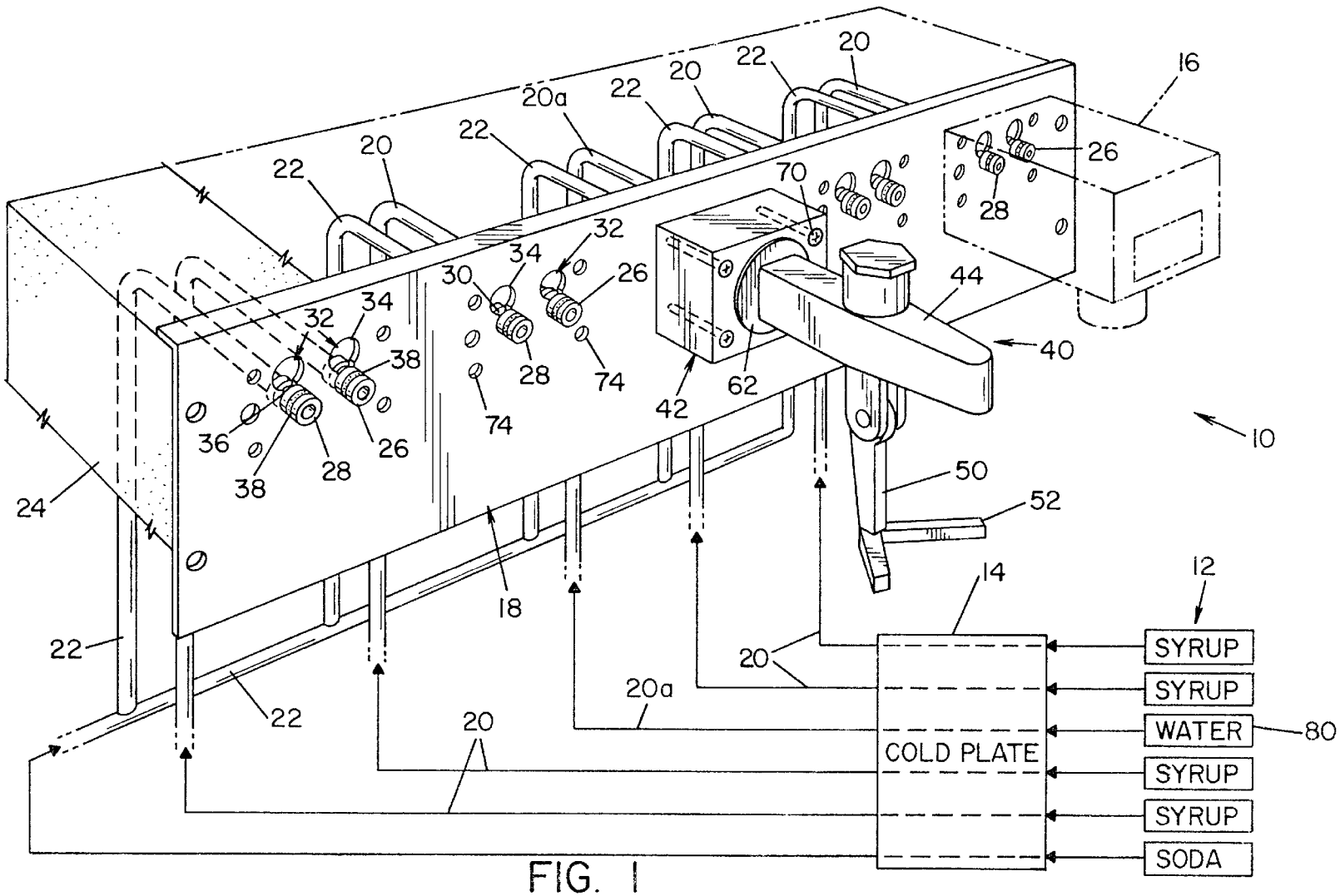
FIG. 1 is a schematic view of a beverage dispenser in accordance with the present invention not showing elements not relevant to the present invention.

Referring now to the drawing wherein the showings are for purposes of illustrating a preferred embodiment of the invention only and not for the purposes of limiting same, the Figures show a postmix beverage dispenser 10 schematically. Such beverage dispensers are commercially available and described in a large number of patents including U.S. Pat. No. 5,392,960 to Kendt, et al. which is incorporated herein by reference.

Carbonated beverage dispensers generally comprise sources of syrup and soda 12, chillers 14 and beverage dispensing valves 16. Flavoring syrup is generally provided in bag and box reservoirs or metallic canisters which are replaceable when empty and conventional in design. Chillers 14 generally take the form of either a cold plate or a mechanical ice bank type refrigeration unit. Both forms of chillers are well developed, commercially available and described in numerous patents.

Dispensing valves 16 are also available from a number of sources commercially and described in a number of patents. Soda water is usually provided by means of a carbonator accepting plain water and carbon dioxide and creating carbonated water at the site of dispensing. These structures are conventional and will not be described in detail.

Modern beverage dispensers come in a wide variety of forms. Quality beverage dispensers share several attributes. Quality beverage dispensers are well insulated. The tubes leading from the chiller 14 to the beverage dispensing valves 16 are normally embedded in a body of insulation which is often foamed in place insulation. This high R value insulation improves the temperature stability of a dispensed beverage. Quality beverage dispensers use syrup and soda delivery tubes terminating in fittings that are accurately positioned. Accurate positioning of the tube end fittings allows for ease of interchange of beverage dispensing valve 16 and also prevents leaks. A face plate 18 or the like is often used to position the ends of syrup delivery tubes 20 and soda delivery tubes 22. The face plate 18 holds the tubes 20, 22 rigidly in place during manufacturing when foamed in place insulation 24 is applied. The tube ends are provided with a syrup delivery tube end fitting 26 and a soda delivery tube fitting 28. The end fitting are often provided with circumferential recesses 30 which engage apertures 32 in the face plate 18. The apertures 32 have circular portions 34 large enough to admit passage of the end fittings 26, 28. The apertures 32 also have engagement portions 36 which are somewhat smaller in lateral dimension than the circular portions 34 and snugly engage the recesses 30 precisely positioning the end fittings 26, 28. O-rings 38 are positioned in a second circumferential recess in the end fitting. The end fittings with their O-rings 38 are engaged by matching recesses (not shown) in a beverage dispensing valve 16 to provide a leakfree fluid flow connection. Face plate 18 stays in place once the beverage dispenser 10 is completed and provides a surface to which beverage dispensing valves 16 may be attached. The face plate 18 also provides protection for the body of insulation. Once such a beverage dispenser 10 is manufactured, the tubing runs cannot be modified without destroying the foamed in place insulation 24.

A water dispensing station 40 in accordance with the present invention is shown in FIG. 1. The water dispensing station takes one of the places normally occupied by a carbonated beverage dispensing valve 16. However, the water dispensing station dispenses plain water.

The water dispensing station comprises an adapter block 42 and a spigot 44. Spigot 44 is conventional and available commercially. Spigot 44 has a threaded end 46 and a central bore 48. Conventionally, the threaded end 46 is attached to a source of water. Water is thereby introduced into the central bore 48. A depending lever 50 has a V-shaped lower end 52 which accommodates a glass to be filled. The glass is pressed against the lever 50 which accuates a valve mechanism within the spigot 44 allowing water to flow from an opening in the spigot 44 above the cup (not shown) thus dispensing water.

In the present invention, the spigot 44 is accommodated in the threaded hole 60 in the adapter block 42. The threaded hole 60 has threads corresponding to those on the threaded end 46 of the spigot 44. In the preferred embodiment, the threads of both are one-half (½) inch national pipe thread. A washer 62 is accommodated in a shallow recess 64 surrounding the hole 60.

Figure 2:
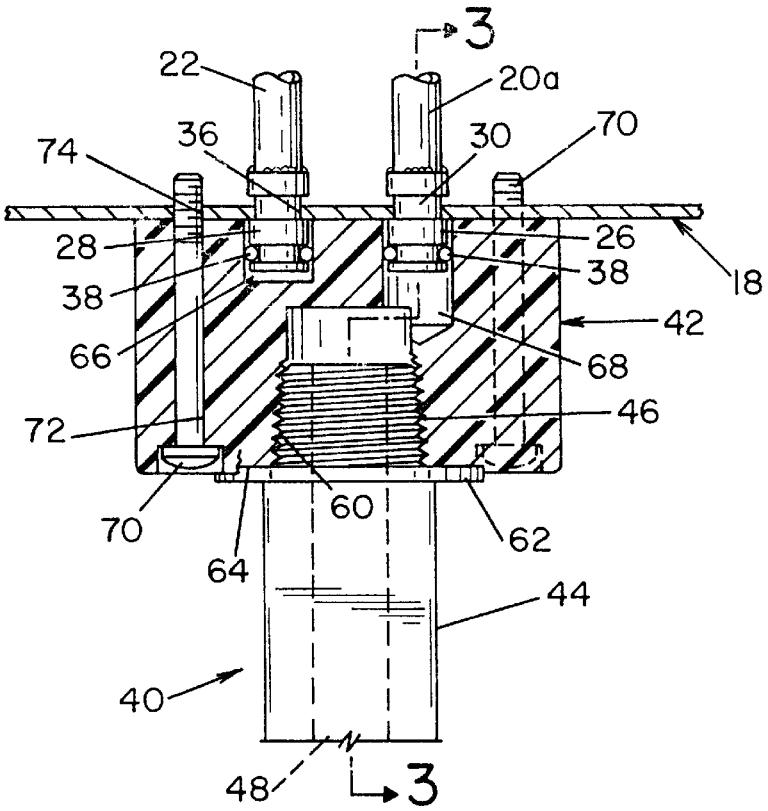
FIG. 2 is a cross-section of the adapter block of the present invention as mounted to a beverage dispenser.
Figure 5:
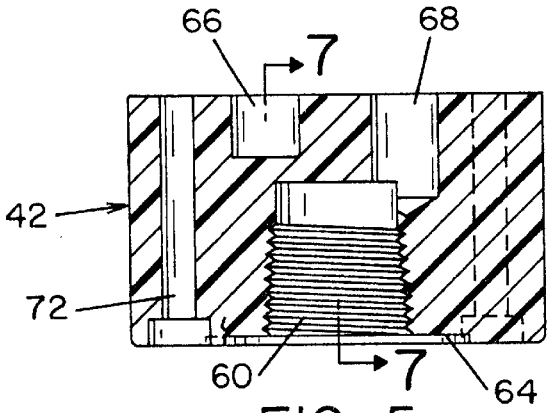
FIG. 5 is a cross-section of the mounting block similar to FIG. 2 but without the other parts.
Figure 7:
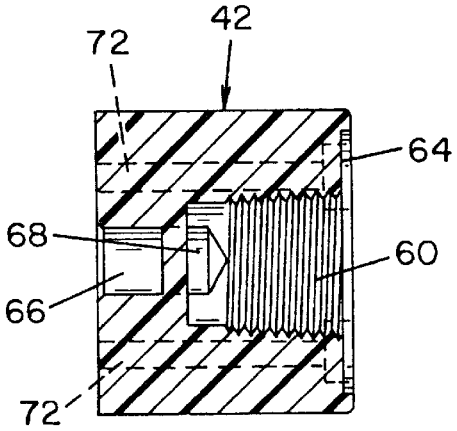
FIG. 7 is a cross-section of the mounting block taken along line 7—7 of FIG. 5.
Figure 6:
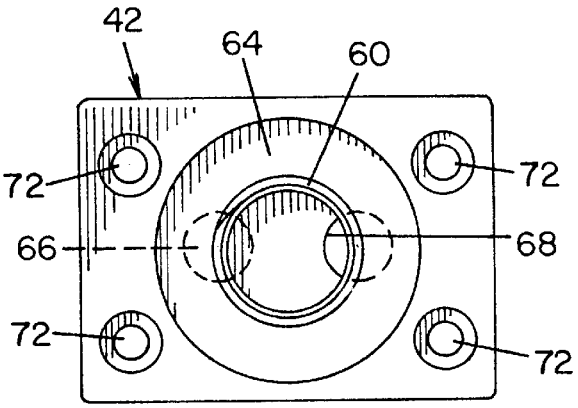
FIG. 6 is a front plan view of the mounting block seen in FIG. 5.

As best seen in FIG. 5, the adapter block 42 is also provided with a soda inlet 66 and a syrup inlet 68. The soda inlet is a blind cylindrical hole in the back of adapter block 42. This can also be seen in FIG. 2, the soda inlet 66 accommodate the soda delivery tube end fitting 28 and cooperates with O-ring 38 to seal the end of the soda delivery tube 22. Thus, soda water delivered through the soda tube 22 to the water station 40 is stopped in the blind soda inlet 66.

Figure 3:
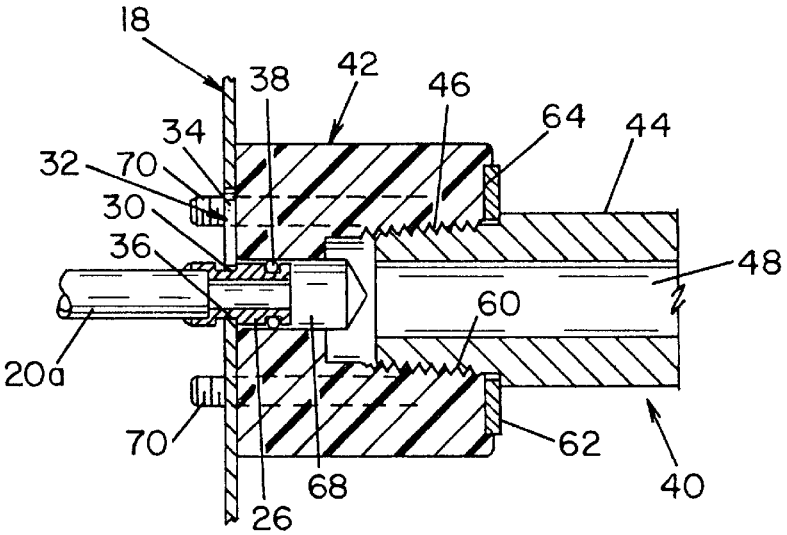
FIG. 3 is a cross-section of the adapter block and a portion of the spigot taken along line 3—3 of FIG. 2.
Figure 4:
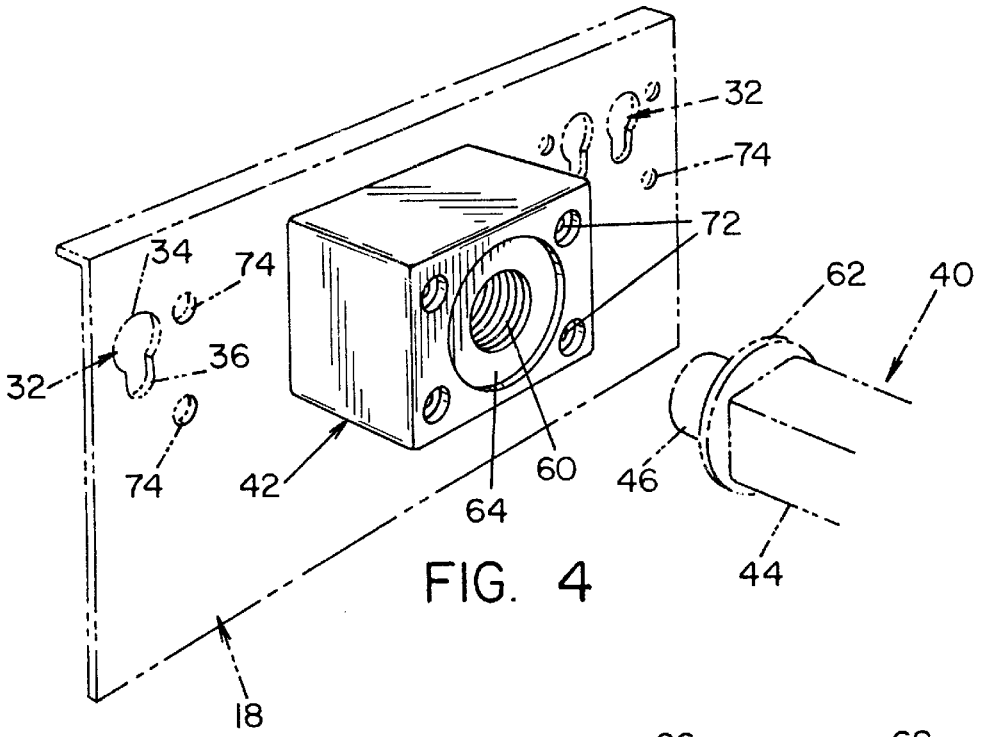
FIG. 4 is a perspective view of the adapter block on a mounting plate with the spigot shown in phantom.

The syrup inlet 68 accommodates the syrup delivery tube end fittings 26. The O-ring 38 seals this joint providing a water-tight connection. The syrup inlet 68 however is not blind. Rather, as seen in FIGS. 3 and 5, it communicates with the threaded hole 60 allowing delivery of fluid to the spigot central bore 48. The adapter block 42 is fixed to the face plate 18 by means of four machine screws 70.

The adapter block 42 is formed from a dimensionally stable material such as Delrin plastic. While a metal block could be used, Delrin plastic is easily formed into the finished shape needed and provides sufficient strength. Screw holes 72 in the adapter block 42 are positioned so that the machine screws 70 mate with tapped hole 74 in the face plate 18. These holes 74 in the face plate 18 are standardized to accept mounting screws for standardized dispensing valve 16.

As can be seen in FIG. 1, one of the syrup delivery tubes 20 is not connected to a source of syrup. Rather, the tube 20*a* in the syrup tube position leading to the water station 40 is connected to a source of water 80 such as the city water delivery pipe. In this way, water from the source of water 80 is passed through the chiller 14, delivered to the adapter block 42 and provided to the spigot 44 for dispensing into a glass or cup. A chilled water dispenser is thereby provided in a carbonated beverage dispensing apparatus. Moreover, the chilled water is provided without the need to modify the internal workings of the beverage dispenser 10. Rather, the only changes necessary are at the face plate 18 and at the source of syrup 12. Changes at these locations are relatively easy.

The adapter block 42 and spigot 44 are easily retrofitted to existing carbonated beverage dispensers by simply removing an existing dispensing valve 16 and substituting the spigot and adapter block therefor. Four machine screws are used to perform the mounting operation and no further sealing steps are needed. A source of water is connected to the syrup tube leading to the water station 40. Installation of the water dispensing station is easily and quickly completed.

The invention has been described with reference to a preferred embodiment. It will be appreciated that modifications or alterations could be made without deviating from the present invention. Such modifications and alterations will occur to others upon reading and understanding of this specification. It is intended that all such modifications and alterations be included insofar as to come within the scope of the appended claims or the equivalents thereof.

Having thus described the invention, it is claimed:

1. A method for providing a plain water dispensing spigot on a prefabricated postmix beverage dispenser, having a chiller for flavoring syrup and soda; a plurality of syrup and soda delivery tubes having first ends connected to sources of fluid and second ends adapted to engage beverage dispensing valves in pairs, one soda tube and one syrup tube for each valve; a body of insulation generally surrounding said delivery tubes; a plate engaging said second ends of said tubes and providing a mounting area for a plurality of beverage dispensing valves, comprising the steps of:

providing an adapter block having a blind soda tube receiving hole, a syrup tube receiving hole and a water dispensing hole in fluid flow communication with said syrup tube receiving hole and having a water spigot mounted in said water dispensing hole;

mounting said adapter block on said plate engaging said second ends of a selected pair comprising a selected soda tube and a selected syrup tube such that said selected soda tube is sealed and said selected syrup tube is in fluid flow communication with said spigot; and, connecting the first end of said selected syrup tube to a source of plain water.

2. A dispensing valve for releasable securing to a beverage dispensing machine, the beverage dispensing machine having a plurality of post-mix beverage dispensing valve attachment locations along a front surface thereof, an equal plurality of syrup delivery tubes, each syrup delivery tube having a first end at one of the attachment locations and a second end fluidly connectable alternately to a source of syrup or to a source of plain water, and having an equal plurality of carbonated water delivery tubes each having a first end at one of the attachment locations and having second ends fluidly connected to a source of carbonated water, the dispensing valve, comprising:

a block portion for releasable securing to a selected one of the post-mix beverage dispensing valve locations, the block portion having a blind hole for receiving a carbonated water delivery tube end of that selected location and having an open hole for receiving a syrup delivery tube end of that selected location, a single fluid dispensing valve mechanism secured to the block portion and in fluid communication with the open hole so that operation of the single fluid dispensing mechanism results in dispensing only of plain water therefrom when the second end of the syrup delivery tube of the selected valve attachment location is fluidly connected to a source of plain water.

3. The valve as defined in claim 1, and the single fluid dispensing valve mechanism threadably secured to the block portion.

4. A method for dispensing water from a post-mix beverage dispensing machine, the beverage dispensing machine having a plurality of post-mix beverage dispensing valve attachment locations along a front surface thereof, an equal plurality of syrup delivery tubes, each syrup delivery tube having a first end at one of the attachment locations and a second end fluidly connectable alternately to a source of syrup or to a source of plain water, and having an equal plurality of carbonated water delivery tubes each having a first end at one of the attachment locations and having second ends fluidly connected to a source of carbonated water, the method of dispensing water, comprising the steps of: securing a single fluid dispensing valve to a selected one of the post-mix beverage dispensing valve locations wherein a carbonated water delivery tube end of that selected location is inserted into a blind hole of a connecting portion of the valve and wherein a syrup delivery tube first end of that selected location is inserted into an open hole of the connecting portion, connecting the syrup delivery tube second end of the syrup delivery tube of the selected location to a source of plain water, operating the single fluid dispensing valve to so that water can flow from the source thereof through the syrup delivery tube of the selected location to and through the connecting portion and out of a spigot of the single fluid dispensing valve.

* * * * *